US006827057B2

(12) United States Patent
Dawson

(10) Patent No.: US 6,827,057 B2
(45) Date of Patent: Dec. 7, 2004

(54) ANGLE BORED CYLINDER ENGINE

(76) Inventor: Ralph E. Dawson, 277 Camby Dr., Kingsport, TN (US) 37664

( * ) Notice: Subject to any disclaimer, the term of this patent is extended or adjusted under 35 U.S.C. 154(b) by 289 days.

(21) Appl. No.: 10/093,540

(22) Filed: Mar. 11, 2002

(65) Prior Publication Data

US 2003/0015165 A1 Jan. 23, 2003

Related U.S. Application Data

(60) Provisional application No. 60/276,165, filed on Mar. 15, 2001.

(51) Int. Cl.[7] ..... F02F 7/00
(52) U.S. Cl. ..... 123/195 R
(58) Field of Search ..... 123/195 R, 195 A, 123/193.2

(56) References Cited

U.S. PATENT DOCUMENTS 5,131,355 A * 7/1992 Bukovics et al. ..... 123/192.2
5,203,857 A * 4/1993 Terwilliger et al. ..... 417/552
5,947,697 A * 9/1999 Morrison ..... 417/237
6,158,402 A * 12/2000 Taguchi et al. ..... 123/53.1
6,244,238 B1 * 6/2001 Takahashi et al. ..... 123/195 R

FOREIGN PATENT DOCUMENTS

JP 02149731 A * 6/1990 ..... F02B/75/32

* cited by examiner

*Primary Examiner*—Henry C. Yuen
*Assistant Examiner*—Hyder Ali

(57) ABSTRACT

A piston/cylinder type engine having increased horsepower and torque wherein the basic components of the engine are constructed and arranged as a standard production single cylinder, "in-line" or "V" engine, but wherein one or more cylinders are bored at an angle of from about 0.025° up to about 15° around the axis of the wrist pin affixing the piston to a connecting rod at TDC, to thereby rotate the bore axis laterally of the crankshaft axis while retaining conventional intersection of the crankshaft axis with the wrist pin axis.

13 Claims, 4 Drawing Sheets

PRIOR ART
16.42
14.86
11.84
10.28
21.78
7.62
6.06
3.04
1.48
0.00
1.72
3.89
2.54
1.42
0.79
0.00
17.80
16.70
15.60
14.50
13.40
12.30
11.20
10.10
9.00
7.90
6.80
5.70
4.60
3.50
2.40
1.30
0.20
18.00

.44 - .45 Dia. C'Bore - .79 Deep
Tap Drill - 1.67 Deep
7/16 - 14 UNC-3B-1.49 Deep
8 Holes
Tap Drill - .76 Deep
5/16 - 18 UNC-3B - .56 Deep
2 Holes
Tap Drill - .74 Deep
1/4-20 UNC-2B - .54 Deep
14 Holes
8.48
6.84
3.24
1.14
2.94
.32
0.00
.34
2.22
4.86
7.50
10.14
12.78
15.42
18.06
20.04
0.00
.10
3.25
1.74
5.04
3.48
9.44
13.84
PRIOR ART
17.95
19.375
19.459
2.94
3.24
8.32

Comparison of Side Forces

ANGLE BORED CYLINDER ENGINE

This application claims priority under 35 U.S.C. 119(e) (1) based on Applicants Provisional U.S. Patent Application Ser. No. 60/276,165 filed Mar. 15, 2001 and titled "Angle Bored Cylinder Engine".

BACKGROUND OF INVENTION

1. Field

The present invention concerns piston/cylinder type engines, particularly internal combustion engines and gas compressors, wherein in accordance with the present invention the cylinders are angle bored, e.g., up to about 15 degrees or more with respect to the bore of conventional engines wherein each cylinder bore is aligned with both of its associated crankpin axis and crankshaft axis at top dead center and bottom dead center of the piston. The present angle bore gives enhanced operation to the engine such as increased horsepower and/or efficiency.

2. Prior Art

The concept of parallel offsetting of the cylinder bore axis to one side of the crankshaft axis in order to enhance the operations of internal combustion engines and compressors is well documented in the literature as evidenced by U.S. Pat. Nos. 3,985,475; 5,186,127; 5,394,839; and 5,076,220, the disclosures of which are hereby incorporated herein in their entireties.

It is apparent from these disclosures that at least most of the major structural components of these engines such as cylinder block, crankshaft, crankpin, connecting rod, camshaft, head, intake and exhaust systems and the like must be specifically designed to accommodate the offset, as well as altering operative elements of combustion such as ignition timing. In other words such offset engines are, for the most part, manufactured from the ground up rather than by a simple modification of existing conventional engines or of their manufacturing processes.

The present invention makes it a relatively simple matter however, to modify an actual existing conventional single cylinder, "in-line" or "V" engine, or to modify its manufacturing process to produce the present angle bored cylinder engine whereby giving the cylinder bore an angled axis is the only significant structural alteration required.

SUMMARY OF THE INVENTION

The present invention is summarized as a piston/cylinder type engine wherein the basic components of the engine are constructed and arranged as a standard production single cylinder, "in-line", "opposed cylinder", or "V" engine, but wherein one or more cylinders are bored at an angle "α" of from about 0.025° up to about 15° around the axis or very near, e.g., a few thousandths of an inch, the axis of the wrist pin affixing the piston to a connecting rod at TDC, to thereby rotate the bore axis generally laterally of the crankshaft axis while retaining intersection of the crankshaft axis with the wrist pin axis as in conventional engines.

BRIEF DESCRIPTION OF THE DRAWINGS

The invention will be further understood from the drawings herein wherein the structures shown are not drawn to scale or proportion, and wherein.

DETAILED DESCRIPTION

Figure 1:
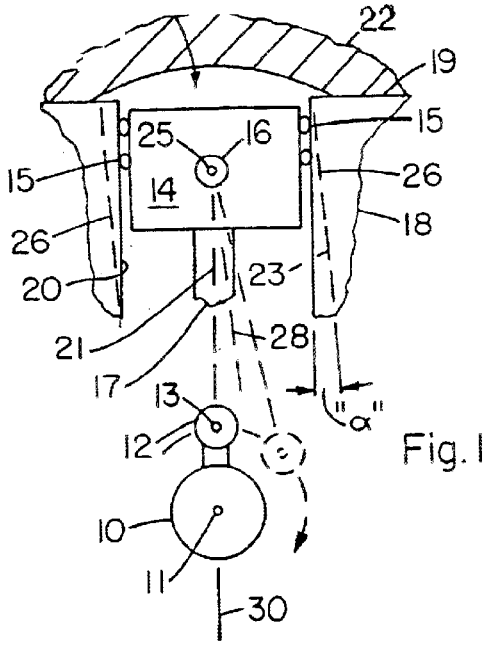
FIG. 1 is a schematic of pertinent structures an internal combustion engine showing exaggerated piston/cylinder clearance for clarity.
Figure 2:
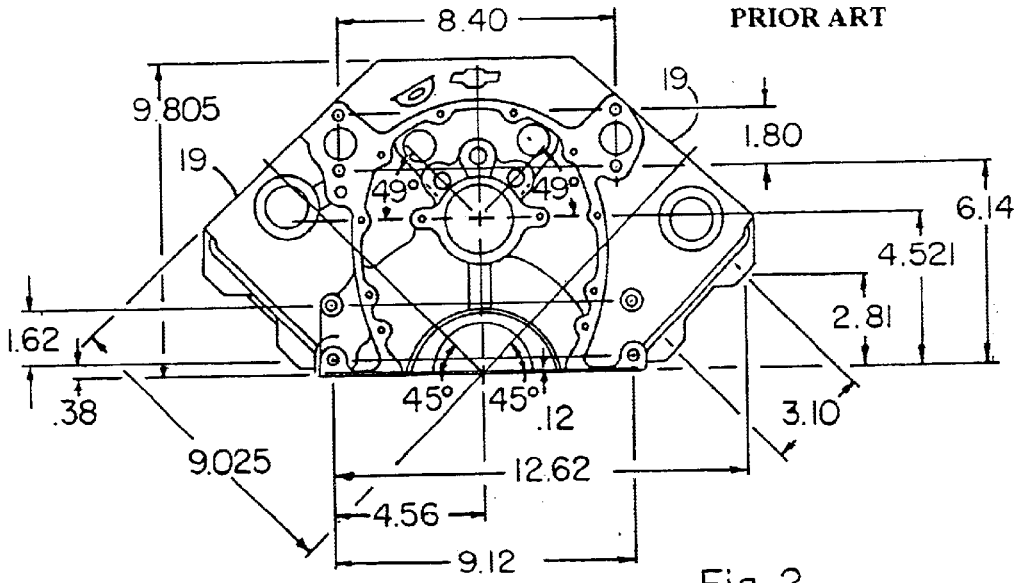
FIGS. 2-6 shows a basic conventional small-block V8 engine cylinder case with nominal dimensions, to which the present invention is applicable.
Figure 3:
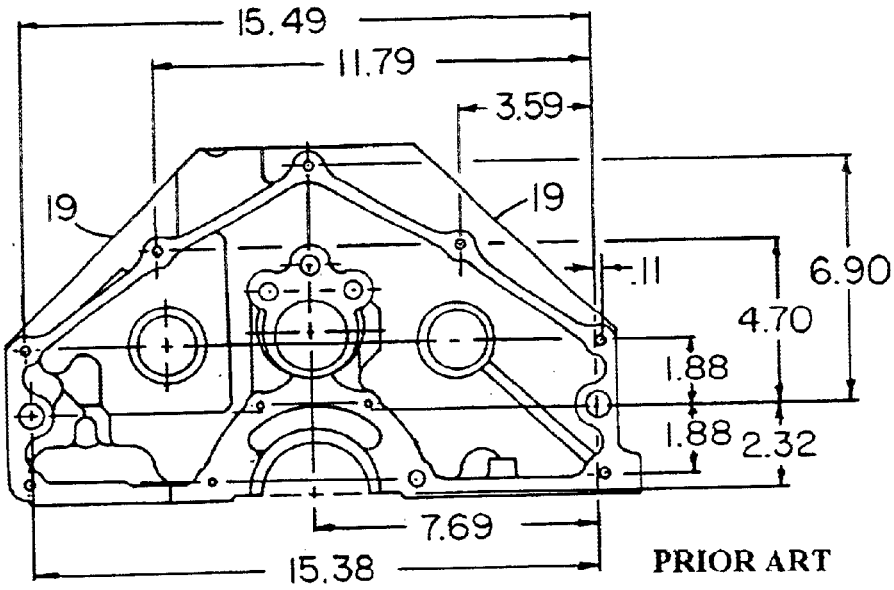
Figure 4:
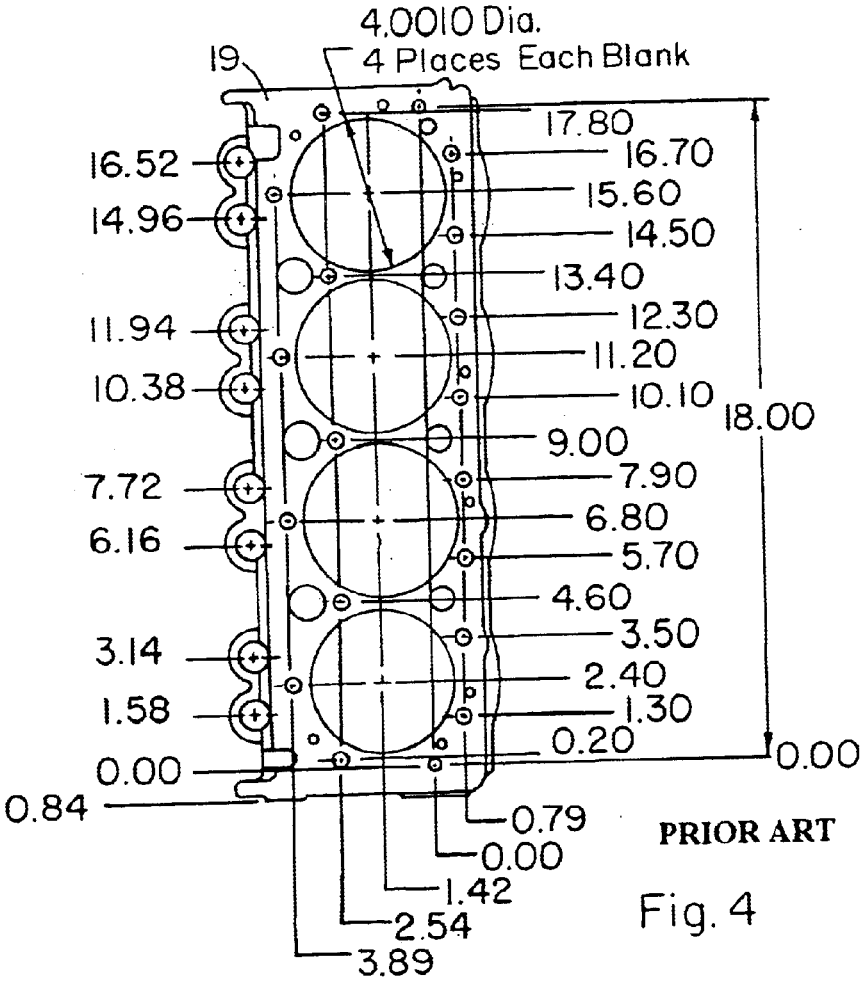
Figures 5, 6:
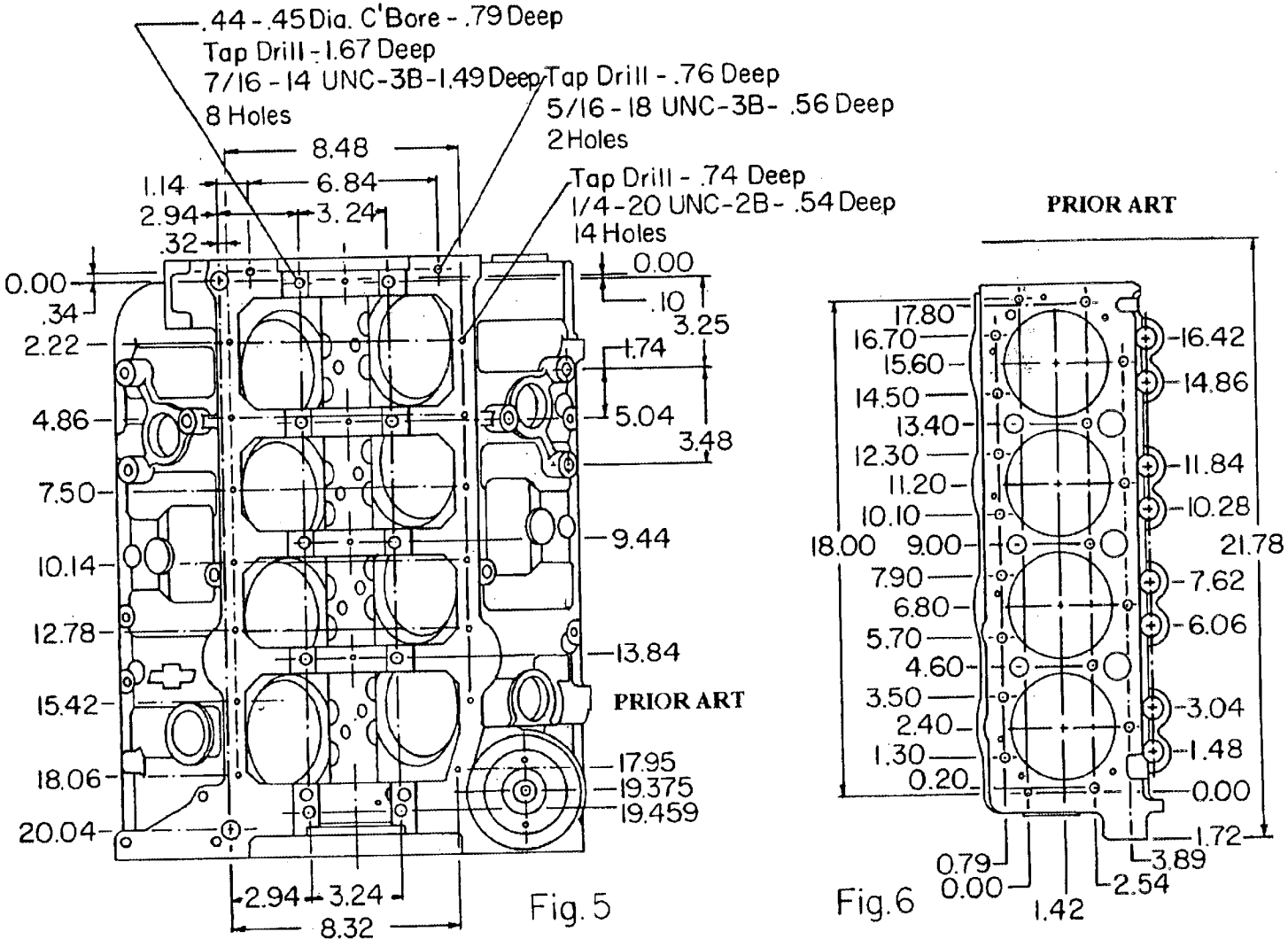

Shown in FIG. 1 are basic components, not in proportion or to scale, of a conventional internal combustion engine comprising crankshaft 10 having a center or axis 11, crankpin 12 having a center or axis 13, piston 14 shown at TDC (top dead center), piston rings 15, wrist pin 16 having a center or axis 25, connecting rod 17, block 18 having a planar cylinder bank face means 19, cylinder bore 20 having a bore axis 21 at right angle to face means 19, head 22 and compression chamber 24 in the head. A typical engine size would be a 350 cu. in., that is, the piston is 4 in., in diameter with 1½" extending above the center 25 (axis) of the wrist pin, wherein the connecting rod is 6" center (axis 25) to center (axis 13), and the crankpin generates a 3½" piston stroke. The center (axis 11) of the mains to the top 19 of the block is 9.025 in.

In FIG. 1, the dotted bore lines 26 represent the diameter of bore 23 angled as "α" in accordance with the present invention wherein the axis 28 of the angled bore passes through the center (axis) 25 of the wrist pin. It is noted that where the angled bore 23 represents a reboring of a conventional cylinder bore such as 20, it may be desirable to employ an oversized piston in known manner, particularly where the bore angle α is in the higher portion of the range.

With reference to FIG. 1 and the claims hereof the present invention comprises a gas compression and/or expansion engine having cylinder block means 18 formed with a planar cylinder bank face means 19, a cylinder bore 23 formed in said block means on a bore axis 28 and opening thru said face means 19, a crankshaft 10 mounted in said block means and having an axis 11 lying parallel to said face means 19, a piston 14 reciprocably positioned in said cylinder, a wrist pin 16 having an axis 25 and mounted thru one end of a connecting rod 17, the other end of said rod being rotatably mounted on a crankpin 12 of said crankshaft, said crankpin having an axis 13 parallel to said crankshaft axis, wherein said wrist pin axis and crankshaft axis lie in a common plane 30 which intersects said planar face means 19 at a right angle, wherein said cylinder bore axis 28 is angled around said wrist pin axis 25 from 0.025 to 15 degrees with respect to said common plane 30 whereby said common plane and bore axis intersect at said wrist pin axis. It is noted that with reference to FIG. 1, for an internal combustion engine said the crankshaft rotation is clockwise, while in a gas compressor the rotation is counterclockwise.

For engines having the present angled bore, the intake and exhaust valves can, without adjustment, open and close also at the theoretical TDC and BDC of the conventional engine. It is noted however that since the piston in the present angle bored cylinder is further down in the cylinder at BDC the intake valving can be adjusted to stay open longer and thus enhance the engine efficiency by increasing the total intake of gases, e.g., fuel air mixture on the suction stroke. Also, the exhaust valving can be adjusted to stay open longer because of the longer power stroke.

A hemihead is shown for clarity in the drawing and the invention involves a simple modification to the block that will result in about a 10% increase in power output. The idea is simply to angle bore the cylinder at an angle "α" of a desired value such as a preferred 3° to about 6°, in the direction of crankshaft rotation. The center of rotation of the piston for the angled bore is preferably exactly the location of the center (axis) of the wrist pin at TDC in the conventional engine, and consequently, and very importantly, the connecting rod length, ignition and piston cam timing and TDC remain the same. The angled bore causes the centerline (bore axis) of the cylinder not to intersect with the centerline (axis) of the crankshaft mains.

The increase in horsepower in accordance with the present invention results, in a major way, from reducing piston friction through a reduction in the side forces on the piston, which friction is normally generated in conventional engines through contact of the piston and/or rings with the cylinder wall. In this regard, the combustion pressure pushes the piston axially down thru the cylinder, however, the piston pushes the rod and consequently thru opposite forces, the piston itself at a given angle toward the cylinder wall as the crankshaft turns. The equation to determine piston side force directed perpendicular to the cylinder wall is SIN $\phi$ Rod Force acting on the crankpin, wherein $\phi$ is the angle which the rod axis makes with the cylinder bore axis.

Figure 7:
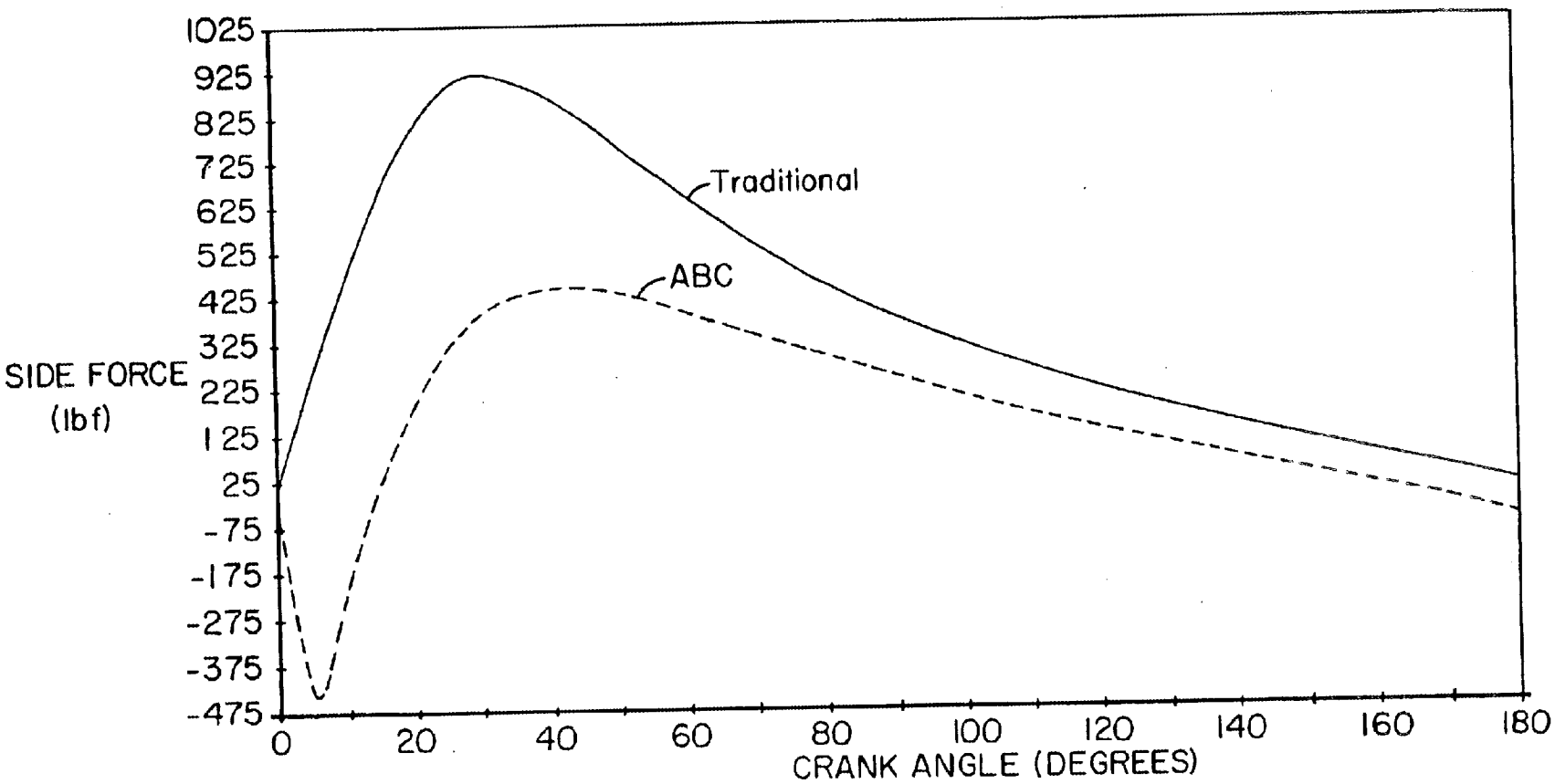
FIG. 7 shows a comparison of side forces generated by the present ABC engine and a traditional engine.

A computer generated comparison of the piston side force between a conventional and angle bored cylinder is presented in TABLE I. The average piston side force reduction is 59.9% less with the angle bored ($\alpha$=4°) cylinder referred to herein as ABC. Computer generated FIG. 7 shows how the force is distributed on the cylinder wall as the crankshaft turns through the power stroke. At 14 degrees there is zero side force with the ABC while the conventional engine has 682 lbs., of side forces.

Another factor in increasing horsepower is that the ABC engine keeps the piston higher in the cylinder longer than the conventional engine. When the piston in the ABC engine is at BDC, the conventional engine has passed BDC by, e.g., 3 degrees. This means that for the ABC engine the power stroke is longer, and more importantly, the intake stroke is longer. It is noted that the fuel combustion pressure drops very fast just after TDC, and since gas pressure on the piston is the main factor in producing HP, the longer the piston remains in the higher pressure area the more HP will be attained.

Another aspect of increasing horsepower is that the torque produced at any moment is a function of the rod force on the crankpin and the moment arm. The rod force is calculated from the piston force through the rod angle. The moment arm is the distance 90 degrees from the rod force to the axis of the crank (crankshaft). The torque is the rod force multiplied by the moment arm. Shown in computer generated TABLE II is the torque produced every 5 degrees during the power stroke for one cylinder of a conventional engine. The average torque is given in inch-pounds. Computer generated TABLE III shows the increase of 2.37% in torque produced by one (ABC) cylinder.

The HP gain from an angle bored cylinder is the result of several factors such as:

1. the side load on the piston is significantly less which results in less frictional drag on the piston as well as longer piston and cylinder life;
2. the piston stays higher in the cylinder under higher pressure longer than a standard engine giving more time for completing combustion;
3. the moment arm becomes longer giving more torque toward the end of the power cycle; and
4. the stroke of the engine is longer which allows for a longer intake stroke sucking more fuel in the cylinder for the compression stroke.

The engine cylinder being angle bored with its axis crossing the axis of the standard cylinder at the wrist pin center has several advantages over parallel offset cylinders or rods or the like including that:

a. the connecting rod is the same length:

b. the camshaft timing is the same;

c. the ignition timing is the same; and d. the average piston deck height is the same.

Using the present invention, many engines now in production can be angle bored and use all of the current production parts. The production cost over current manufactured engines should be nominal with the only significant anticipated production changes being adjustment of the boring and casting machines at start-up.

In an actual test, the test engine was an 800 cu. in., engine that was used in a drag race car. The conventional engine had a peak HP of 1598. A second engine block had the cylinders bored at 1.5° from the crankshaft centerline in accordance with the present invention. The parts from the conventional engine were installed in the angle bored block and the peak HP thereof was 1666.

The specification for the test engine in its conventional condition are as follows:

| | |
|---|---|
| Stroke: | 5.750 in. |
| Bore: | 4,750 in. |
| Rod Length: | 7.750 in. |
| Center of Crankshaft | 12.00 in |
| To top of block: | |
| Timing of approximately 25° BTDC. | |

The invention has been described in detail with particular reference to preferred embodiments thereof, but it will be understood that variations and modifications will be effected with the spirit and scope of the invention.

TABLE I

| | | | | Side Forces* | | | |
|---|---|---|---|---|---|---|---|
| Crank Angle (degrees) | ABC Rod Force (lbf) | ABC Rod Angle (degrees) | ABC Side Force** (lbf) | Traditional Rod Force (lbf) | Traditional Rod Angle (degrees) | Traditional Side Force (lbf) | Percent Difference In Side Force (%) |
| 0 | 10053.1 | 0.0 | 0.0 | 10053.1 | 0.0 | 0.0 | 0.0 |
| 5 | 9837.4 | −2.5 | −437.5 | 9827.8 | 1.5 | 255.6 | −271.2 |
| 10 | 9207.0 | −1.1 | −179.9 | 9204.4 | 2.9 | 497.8 | −136.1 |
| 15 | 8318.4 | 0.3 | 40.4 | 8314.2 | 4.3 | 694.8 | −94.2 |
| 20 | 7320.7 | 1.6 | 208.9 | 7308.4 | 5.7 | 829.4 | −74.8 |
| 25 | 6333.0 | 2.9 | 324.9 | 6309.5 | 7.1 | 900.9 | −63.9 |
| 30 | 5428.3 | 4.2 | 396.2 | 5393.2 | 8.4 | 920.1 | −56.9 |

TABLE I-continued

| Crank Angle (degrees) | ABC Rod Force (lbf) | ABC Rod Angle (degrees) | ABC Side Force** (lbf) | Traditional Rod Force (lbf) | Traditional Rod Angle (degrees) | Traditional Side Force (lbf) | Percent Difference In Side Force (%) |
|---|---|---|---|---|---|---|---|
| | | | Side Forces* | | | | |
| 35 | 4638.0 | 5.4 | 433.4 | 4592.8 | 9.6 | 902.2 | −52.0 |
| 40 | 3969.4 | 6.5 | 446.6 | 3916.1 | 10.8 | 861.1 | −48.1 |
| 45 | 3411.8 | 7.5 | 443.6 | 3352.9 | 11.9 | 807.7 | −45.1 |
| 50 | 2951.5 | 8.4 | 430.5 | 2889.1 | 12.9 | 749.1 | −42.5 |
| 55 | 2572.1 | 9.2 | 411.3 | 2508.1 | 13.8 | 690.3 | −40.4 |
| 60 | 2259.2 | 9.9 | 388.7 | 2195.1 | 14.6 | 633.5 | −38.6 |
| 65 | 2000.7 | 10.5 | 364.5 | 1937.7 | 15.3 | 580.3 | −37.2 |
| 70 | 1785.7 | 11.0 | 339.8 | 1724.8 | 15.9 | 531.1 | −36.0 |
| 75 | 1607.3 | 11.3 | 315.4 | 1549.2 | 16.4 | 485.9 | −35.1 |
| 80 | 1457.1 | 11.5 | 291.4 | 1402.2 | 16.7 | 445.0 | −34.5 |
| 85 | 1330.3 | 11.6 | 268.1 | 1279.1 | 16.9 | 407.4 | −34.2 |
| 90 | 1222.8 | 11.6 | 245.6 | 1175.5 | 17.0 | 373.1 | −34.2 |
| 95 | 1131.2 | 11.4 | 224.0 | 1088.0 | 16.9 | 341.5 | −34.4 |
| 100 | 1052.9 | 11.1 | 203.1 | 1013.8 | 16.7 | 312.5 | −35.0 |
| 105 | 985.6 | 10.7 | 183.0 | 950.7 | 16.4 | 285.6 | −35.9 |
| 110 | 927.6 | 10.2 | 163.6 | 896.8 | 15.9 | 260.6 | −37.2 |
| 115 | 877.6 | 9.5 | 144.8 | 850.8 | 15.3 | 237.1 | −38.9 |
| 120 | 834.4 | 8.7 | 126.6 | 811.4 | 14.6 | 214.9 | −41.1 |
| 125 | 797.1 | 7.8 | 108.9 | 777.8 | 13.8 | 193.9 | −43.9 |
| 130 | 765.0 | 6.9 | 91.6 | 749.1 | 12.9 | 173.8 | −47.3 |
| 135 | 737.4 | 5.8 | 74.7 | 724.6 | 11.9 | 154.5 | −51.7 |
| 140 | 713.8 | 4.7 | 58.1 | 703.8 | 10.8 | 135.8 | −57.3 |
| 145 | 693.9 | 3.4 | 41.7 | 686.3 | 9.6 | 117.7 | −64.6 |
| 150 | 677.3 | 2.2 | 25.6 | 671.8 | 8.4 | 100.1 | −74.5 |
| 155 | 663.7 | 0.8 | 9.6 | 660.0 | 7.1 | 82.8 | −88.4 |
| 160 | 653.0 | −0.6 | −6.3 | 650.6 | 5.7 | 65.8 | −109.6 |
| 165 | 645.0 | −2.0 | −22.2 | 643.5 | 4.3 | 49.1 | −145.2 |
| 170 | 639.4 | −3.4 | −38.1 | 638.5 | 2.9 | 32.6 | −217.0 |
| 175 | 636.4 | −4.9 | −54.1 | 635.6 | 1.5 | 16.2 | −433.3 |
| 180 | 635.7 | −6.3 | −70.2 | 634.6 | 0.0 | 0.0 | — |
| 183.3 | 636.5 | −7.3 | −80.9 | — | — | — | — |
| | Average Side Force = 164.3 | | | Average Side Force = 409.7 | | | |
| | | | Percent Difference of Average Side Force = 59.9% | | | | |

*Side force is perpendicular to cylinder wall.
**Negative force acts in the opposite direction of positive force.

TABLE II

| Crank Angle (degrees) | Distance From TDC (inches) | Moment Arm (inches) | Rod Angle (degrees) | Pressure (psig) | Rod Force (lbf) | Piston Force (lbf) | Torque (in*lb) |
|---|---|---|---|---|---|---|---|
| | | | Traditional Engine Parameters | | | | |
| 0 | 0.000 | 0.000 | 0.000 | 800.0 | 10053.1 | 10053.1 | 0.0 |
| 5 | 0.009 | 0.197 | 1.457 | 782.1 | 9827.8 | 9824.6 | 1934.0 |
| 10 | 0.034 | 0.391 | 2.903 | 732.5 | 9204.4 | 9192.6 | 3596.9 |
| 15 | 0.077 | 0.579 | 4.329 | 661.6 | 8314.2 | 8290.5 | 4815.9 |
| 20 | 0.135 | 0.760 | 5.725 | 581.6 | 7308.4 | 7272.0 | 5551.5 |
| 25 | 0.210 | 0.929 | 7.080 | 502.1 | 6309.5 | 6261.4 | 5864.3 |
| 30 | 0.299 | 1.087 | 8.386 | 429.2 | 5393.2 | 5335.5 | 5860.5 |
| 35 | 0.401 | 1.229 | 9.630 | 365.5 | 4592.8 | 4528.1 | 5646.5 |
| 40 | 0.516 | 1.356 | 10.806 | 311.6 | 3916.1 | 3846.7 | 5311.3 |
| 45 | 0.642 | 1.466 | 11.902 | 266.8 | 3352.9 | 3280.8 | 4915.5 |
| 50 | 0.777 | 1.558 | 12.911 | 229.9 | 2889.1 | 2816.1 | 4501.3 |
| 55 | 0.920 | 1.632 | 13.823 | 199.6 | 2508.1 | 2435.4 | 4092.7 |
| 60 | 1.070 | 1.687 | 14.631 | 174.7 | 2195.1 | 2123.9 | 3704.1 |
| 65 | 1.224 | 1.725 | 15.328 | 154.2 | 1937.7 | 1868.8 | 3342.8 |
| 70 | 1.381 | 1.746 | 15.907 | 137.3 | 1724.8 | 1658.7 | 3010.6 |
| 75 | 1.540 | 1.750 | 16.363 | 123.3 | 1549.2 | 1486.4 | 2710.3 |
| 80 | 1.699 | 1.738 | 16.693 | 111.6 | 1402.2 | 1343.1 | 2437.1 |
| 85 | 1.856 | 1.712 | 16.891 | 101.8 | 1279.1 | 1223.9 | 2190.3 |
| 90 | 2.011 | 1.674 | 16.958 | 93.5 | 1175.5 | 1124.4 | 1967.7 |
| 95 | 2.161 | 1.624 | 16.891 | 86.6 | 1088.0 | 1041.1 | 1766.7 |
| 100 | 2.307 | 1.564 | 16.693 | 80.7 | 1013.8 | 971.1 | 1585.1 |
| 105 | 2.446 | 1.494 | 16.363 | 75.7 | 950.7 | 912.2 | 1420.6 |
| 110 | 2.578 | 1.417 | 15.907 | 71.4 | 896.8 | 862.5 | 1271.2 |
| 115 | 2.703 | 1.334 | 15.328 | 67.7 | 850.8 | 820.5 | 1135.1 |
| 120 | 2.820 | 1.245 | 14.631 | 64.6 | 811.4 | 785.1 | 1010.6 |

TABLE II-continued

Traditional Engine Parameters

| Crank Angle (degrees) | Distance From TDC (inches) | Moment Arm (inches) | Rod Angle (degrees) | Pressure (psig) | Rod Force (lbf) | Piston Force (lbf) | Torque (in*lb) |
|---|---|---|---|---|---|---|---|
| 125 | 2.928 | 1.152 | 13.823 | 61.9 | 777.8 | 755.3 | 896.2 |
| 130 | 3.027 | 1.055 | 12.911 | 59.6 | 749.1 | 730.1 | 790.5 |
| 135 | 3.116 | 0.956 | 11.902 | 57.7 | 724.6 | 709.0 | 692.4 |
| 140 | 3.197 | 0.854 | 10.806 | 56.0 | 703.8 | 691.3 | 600.8 |
| 145 | 3.268 | 0.750 | 9.630 | 54.6 | 686.3 | 676.7 | 514.6 |
| 150 | 3.330 | 0.645 | 8.386 | 53.5 | 671.8 | 664.7 | 433.1 |
| 155 | 3.382 | 0.538 | 7.080 | 52.5 | 660.0 | 655.0 | 355.4 |
| 160 | 3.424 | 0.432 | 5.725 | 51.8 | 650.6 | 647.4 | 280.8 |
| 165 | 3.457 | 0.324 | 4.329 | 51.2 | 643.5 | 641.7 | 208.5 |
| 170 | 3.481 | 0.216 | 2.903 | 50.8 | 638.5 | 637.7 | 138.1 |
| 175 | 3.495 | 0.108 | 1.457 | 50.6 | 635.6 | 635.4 | 68.7 |
| 180 | 3.500 | 0.000 | 0.000 | 50.5 | 634.6 | 634.6 | 0.0 |
| | | | | | | Average Torque = | 2350.6 |

TABLE III

ABC Engine Parameters

| Crank Angle (degrees) | Distance From TDC (inches) | Moment Arm (inches) | Rod Angle (degrees) | Pressure (psig) | Rod Force (lbf) | Piston Force (lbf) | Torque (in*lb) |
|---|---|---|---|---|---|---|---|
| 0 | 0.000 | 0.000 | 0.0 | 800.0 | 10053.1 | 10053.1 | 0.0 |
| 5 | 0.009 | 0.197 | −2.5 | 782.1 | 9837.4 | 9827.6 | 1934.2 |
| 10 | 0.034 | 0.390 | −1.1 | 732.5 | 9207.0 | 9205.2 | 3591.7 |
| 15 | 0.077 | 0.578 | 0.3 | 661.9 | 8318.4 | 8318.3 | 4806.1 |
| 20 | 0.135 | 0.757 | 1.6 | 582.3 | 7320.7 | 7317.7 | 5542.6 |
| 25 | 0.208 | 0.926 | 2.9 | 503.3 | 6333.0 | 6324.6 | 5863.2 |
| 30 | 0.296 | 1.082 | 4.2 | 430.8 | 5428.3 | 5413.8 | 5872.7 |
| 35 | 0.397 | 1.224 | 5.4 | 367.5 | 4638.0 | 4617.7 | 5675.0 |
| 40 | 0.510 | 1.350 | 6.5 | 313.9 | 3969.4 | 3944.2 | 5357.0 |
| 45 | 0.634 | 1.459 | 7.5 | 269.2 | 3411.8 | 3382.8 | 4977.2 |
| 50 | 0.767 | 1.551 | 8.4 | 232.4 | 2951.5 | 2919.9 | 4576.8 |
| 55 | 0.907 | 1.625 | 9.2 | 202.0 | 2572.1 | 2539.0 | 4179.2 |
| 60 | 1.053 | 1.681 | 9.9 | 177.1 | 2259.2 | 2225.5 | 3798.6 |
| 65 | 1.204 | 1.721 | 10.5 | 156.5 | 2000.7 | 1967.2 | 3442.5 |
| 70 | 1.358 | 1.743 | 11.0 | 139.5 | 1785.7 | 1753.1 | 3113.0 |
| 75 | 1.514 | 1.750 | 11.3 | 125.4 | 1607.3 | 1576.1 | 2812.8 |
| 80 | 1.669 | 1.742 | 11.5 | 113.6 | 1457.1 | 1427.7 | 2538.1 |
| 85 | 1.824 | 1.720 | 11.6 | 103.7 | 1330.3 | 1303.0 | 2288.1 |
| 90 | 1.975 | 1.686 | 11.6 | 95.3 | 1222.8 | 1197.9 | 2061.2 |
| 95 | 2.124 | 1.640 | 11.4 | 88.2 | 1131.2 | 1108.8 | 1855.3 |
| 100 | 2.267 | 1.584 | 11.1 | 82.2 | 1052.9 | 1033.1 | 1668.2 |
| 105 | 2.405 | 1.520 | 10.7 | 77.1 | 985.6 | 968.4 | 1498.2 |
| 110 | 2.537 | 1.448 | 10.2 | 72.7 | 927.6 | 913.0 | 1343.3 |
| 115 | 2.662 | 1.370 | 9.5 | 68.9 | 877.6 | 865.5 | 1201.9 |
| 120 | 2.779 | 1.286 | 8.7 | 65.6 | 834.4 | 824.7 | 1072.6 |
| 125 | 2.889 | 1.197 | 7.8 | 62.8 | 797.1 | 789.6 | 954.0 |
| 130 | 2.990 | 1.104 | 6.9 | 60.4 | 765.0 | 759.5 | 844.7 |
| 135 | 3.083 | 1.008 | 5.8 | 58.4 | 737.4 | 733.6 | 743.6 |
| 140 | 3.167 | 0.910 | 4.7 | 56.6 | 713.8 | 711.5 | 649.6 |
| 145 | 3.242 | 0.810 | 3.4 | 55.1 | 693.9 | 692.7 | 561.7 |
| 150 | 3.308 | 0.707 | 2.2 | 53.9 | 677.3 | 676.8 | 479.0 |
| 155 | 3.366 | 0.604 | 0.8 | 52.8 | 663.7 | 663.7 | 400.6 |
| 160 | 3.414 | 0.499 | −0.6 | 52.0 | 653.0 | 653.0 | 325.6 |
| 165 | 3.453 | 0.393 | −2.0 | 51.3 | 645.0 | 644.6 | 253.4 |
| 170 | 3.482 | 0.286 | −3.4 | 50.8 | 639.4 | 638.3 | 183.1 |
| 175 | 3.503 | 0.179 | −4.9 | 50.5 | 636.4 | 634.1 | 114.0 |
| 180 | 3.514 | 0.071 | −6.3 | 50.3 | 635.7 | 631.8 | 45.4 |
| 183.3 | 3.516 | 0.000 | −7.3 | 50.2 | 636.5 | 631.4 | 0.1 |
| | | | | | Average Torque = | | 2406.2 |
| | | | | | Traditional Torque = | | 2350.6 |
| | | | | | Percent Increase = | | 2.37 |

I claim:

1. A gas compression and/or expansion engine having cylinder block means formed with a planar cylinder bank face means, a cylinder formed in said block means on a bore axis and opening thru said face means, a crankshaft mounted in said block means and having an axis lying parallel to said face means, a piston reciprocably positioned in said cylinder, a wrist pin mounted on said piston along a diameter thereof and also being mounted thru one end of a connecting rod, the other end of said rod being rotatably mounted on a crankpin of said crankshaft, said crankpin having an axis parallel to said crankshaft axis, wherein an axis of said wrist pin and said crankshaft axis lie in a common plane which intersects said planar face means at a right angle, wherein said cylinder bore axis is angled around said wrist pin axis at TDC from 0.025 to 15 degrees with respect to said common plane whereby said common plane and bore axis intersect at said wrist pin axis.

2. The engine of claim 1 comprising an internal combustion engine wherein said bore axis is angled around said wrist pin axis toward the power stroke side of said crankshaft.

3. The engine of claim 2 wherein all of the structural components are from a conventional internal combustion engine which carries only the structural modification of the angle bored cylinder.

4. The engine of claim 1 wherein multiple cylinders and pistons are provided and wherein a selected one or more of said cylinders is angle bored.

5. The engine of claim 1 wherein said block means has "in-line" cylinders.

6. The engine of claim 4 wherein said block means has "V" oriented opposed cylinder banks.

7. The engine of claim 4 comprising a "V8" engine.

8. The engine of claim 1 comprising a gas compressor wherein said bore axis is angled around said wrist pin toward the compression stroke side of said crankshaft.

9. The compressor of claim 8 wherein all of the structural components are from a conventional gas compressor which carries only the structural modification of the angle bored cylinder.

10. The compressor of claim 8 wherein multiple cylinders and pistons are provided and wherein a selected one or more of said cylinders is angle bored.

11. The compressor of claim 8 wherein said block means has "in-line" cylinders.

12. The compressor of claim 8 wherein said block means has "V" oriented opposed cylinder banks.

13. The compressor of claim 9 comprising a refrigerant gas compressor.

* * * * *